US007430849B1

(12) United States Patent
Coutts et al.

(10) Patent No.: US 7,430,849 B1
(45) Date of Patent: Oct. 7, 2008

(54) CONVEYOR CHAIN PIN REMOVER

(75) Inventors: Stephen Coutts, Santa Monica, CA (US); Sanford Fitelson, Torrance, CA (US)

(73) Assignee: Practical Inventions, LLC, Torrance, CA (US)

( * ) Notice: Subject to any disclaimer, the term of this patent is extended or adjusted under 35 U.S.C. 154(b) by 0 days.

(21) Appl. No.: 12/122,481

(22) Filed: May 16, 2008

(51) Int. Cl.
*B21L 21/00* (2006.01)
*B25B 13/00* (2006.01)

(52) U.S. Cl. ..... 59/7; 59/11; 7/138; 81/57; 81/63.2; 29/243.53

(58) Field of Classification Search ..... 59/7, 59/11, 35.1; 81/57.3, 63.2; 7/138; 29/243.53
See application file for complete search history.

(56) References Cited

U.S. PATENT DOCUMENTS 1,469,594 A 10/1923 Harley
2,895,289 A 7/1959 Wognum et al.
2,904,955 A 9/1959 Kreiter
3,172,250 A 3/1965 Eastep
3,379,005 A 4/1968 Jones
3,698,181 A 10/1972 Paul et al.
4,063,412 A * 12/1977 Bruzek ..... 59/7
4,157,594 A 6/1979 Raabe
4,570,436 A 2/1986 Wilkie
4,870,739 A * 10/1989 Richards ..... 29/252
5,140,736 A 8/1992 Hsiao
5,222,354 A 6/1993 Rothstein
5,463,862 A 11/1995 Reisenauer
5,752,377 A 5/1998 Small
5,787,701 A 8/1998 Small
5,934,061 A 8/1999 Smith
6,453,657 B1 9/2002 Teravainen
6,748,637 B2 6/2004 Meggiolan
7,082,747 B2 8/2006 Oishi et al.
7,100,353 B1 9/2006 Maguire
7,254,935 B1 * 8/2007 Huang ..... 59/7
2007/0193247 A1 8/2007 Daniels et al.

* cited by examiner

*Primary Examiner*—David B Jones
(74) *Attorney, Agent, or Firm*—David A. Belasco; Belasco Jacobs & Townsley, LLP

(57) ABSTRACT

A conveyor chain pin remover includes a gear case with an attached handle, an actuating lever, a ratchet mechanism engaged by the actuating lever and first and second aligned passthrough openings. A retaining bar, is attached adjacent a first end to the gear case and has a chain retaining fixture located adjacent a second end. The chain retaining fixture has a barrier portion located orthogonally to the retaining bar and has a central aperture located in the barrier portion. A ram has a pin punch portion located at a first end and a rack portion extending substantially from a second end toward the pin punch portion. The rack portion fits slidably through the first and second aligned passthrough openings with teeth of the rack portion engaging the ratchet mechanism. The pin punch portion fits slidably through the central aperture and is smaller in diameter than pins of a roller chain.

7 Claims, 5 Drawing Sheets

CONVEYOR CHAIN PIN REMOVER

FIELD OF INVENTION

This invention relates to the field of material handling equipment maintenance. More specifically, the invention relates to devices for servicing roller chains associated with material handling conveyors.

BACKGROUND OF THE INVENTION

Many factories, warehouses and supply depots utilize roller conveyors to move materials from one location to another within the facility. While some of these conveyors are gravity operated, many require power to move materials uphill or on a level grade. These conveyors are often powered by a roller chain driven by an electric motor or other power source. These roller chains must be serviced at regularly and most be replaced at regular intervals due to stretching and wear. In order to remove a roller chain or a damaged section of one, it is necessary to push out the pins that fasten the links together. Reassembling the chains is done by pushing this pin back into the links. These tasks are typically done with a pin punch and a hammer. As the chains are often large, heavy and positioned closely to other machinery, a pin punch and hammer is often awkward to use in the required close quarters. Other means have been developed to address this problem as described in the patents discussed below.

U.S. Pat. No. 5,463,862, issued to Reisenauer, discloses a breaker for roller chains that includes a rigid frame with a chain receiving opening. A clamp member with an open pin receiving bore is mounted to the rigid frame on one side of the opening for adjustment along an axis. A punch block with a central bore is releasably mounted to the rigid frame on an opposite side of the opening. The punch block is located by a positioner with its central bore substantially coaxial with the axis. The punch block and clamp member include chain link engaging surfaces positioned relative to the opening to releasably clamp a roller chain with a pin thereof aligned with the axis and with the link engaging surfaces in clamping engagement with chain side plates adjacent the pin. A punch pin is slidably mounted within the punch block central bore, with a pin driving end movable through the opening and receivable axially within the pin receiving bore of the clamp member. A headed end of the punch pin is releasably mounted to the ram shaft by a freely rotatable cleat on a saddle that is releasably mounted at the end of a ram shaft. A ram drives the ram shaft and attached punch pin to move along the axis through a prescribed axial stroke to force the pin from the chain.

U.S. Pat. No. 6,453,657, issued to Teravainen is directed to a portable hydraulic press with two opposing plates connected by bolts can be clamped on a conveyor chain that has interference-fit connecting pins between pairs of rectangular plates forming the chain links to assemble or disassemble the chain. Once the press is clamped in place, a hydraulic cylinder of the press is then actuated to force the connecting pin in or out of the chain. If the pin is being pushed out, it passes through a hole in a back plate of the press in order to disassemble or break the chain.

U.S. Patent Application No. 2007/0193247, published for Daniels et al. illustrates a fluid activated connecting pin removal tool that includes a body defining a first cavity adapted to receive a portion of a work piece and a second cavity positioned substantially perpendicular to and intersecting the first cavity. When a fluid activated cylinder is mounted to the body in a first orientation relative to the second cavity, expansion of the fluid activated cylinder results in a piston extending from the cylinder into the first cavity in which the work piece is positioned to exert a force upon a connecting pin connecting portions of the work piece. When the fluid activated cylinder is mounted to the body in a second orientation relative to the second cavity, the secondary cavity serves as a storage compartment for the fluid activated cylinder.

U.S. Pat. No. 6,748,637, issued to Meggiolan disclose a tool for inserting and extracting pins of roller chains, comprising a body having a pair of teeth designed to engage two chain links to be connected or separated by insertion or extraction of a pin. The tool comprises a screw member which can be operated manually and which is provided with a punch designed to co-operate with a pin that is to be inserted or extracted. The tool comprises two retaining elements which can move between an inoperative position, in which the chain links can freely engage and disengage the teeth, and an operative position, in which the teeth block the chain links in a pre-set position with respect to the teeth.

U.S. Pat. No. 5,934,061, issued to Smith is directed an apparatus for assembling and disassembling roller chain and the like is provided. The apparatus includes a base portion made up of a base plate and side plates, a rotatable cam and an interchangeable die set inserted into the base portion which is in contact with the cam. The die set is sized to fit a particular type and size of chain. The particular die set may be designed to punch out connecting pins in a link of the chain. Alternatively, the die set may be for purposes of installing a link plate onto connecting pins or for purposes of deforming the ends of connecting pins during the assembly process.

It is an objective of the present invention to provide a compact, easy-to use system for servicing roller chains. It is a further objective to provide such a system that does not require an external power source. It is a still further objective of the invention to provide a system that can be operated with one hand and that will work in tightly confined locations. Finally, it is an objective of the present invention to provide such apparatus that is durable, inexpensive and simple for the operator to use.

While some of the objectives of the present invention are disclosed in the prior art, none of the inventions found include all of the requirements identified.

SUMMARY OF THE INVENTION

The present invention addresses all of the deficiencies of prior conveyor chain pin remover inventions and satisfies all of the objectives described above.

(1) A conveyor chain pin remover providing the desired features may be constructed from the following components. A gear case is provided. The gear case has an attached handle, an actuating lever, a ratchet mechanism engaged by the actuating lever and first and second aligned passthrough openings. A retaining bar is provided. The retaining bar has a first end and a second end, is attached adjacent the first end to the gear case and has a chain retaining fixture located adjacent the second end. The chain retaining fixture has a barrier portion located orthogonally to the retaining bar and has a central aperture located in the barrier portion. A ram is provided. The ram has a first end, a second end, a pin punch portion located at the first end and a rack portion extending substantially from the second end toward the pin punch portion.

The rack portion is sized and shaped to fit slidably through the first and second aligned passthrough openings with teeth of the rack portion engaging the ratchet mechanism. The pin punch portion is sized, shaped and located to fit slidably through the central aperture and is smaller in diameter than pins of a roller chain.

(2) In a variant of the invention, a ratchet release is provided. The ratchet release moves between a first position and a second position, alternately engaging and disengaging the ratchet mechanism and the actuating lever. A spring is provided. The spring urges the ratchet release toward the first position. When the ratchet release is in the second position, the rack portion of the ram slides freely through the first and second aligned passthrough openings.

(3) In another variant, the ratchet mechanism further includes a spur gear. The spur gear has teeth sized and shaped to engage the teeth of the rack portion. A ratchet wheel is provided. The ratchet wheel has angled teeth and is fixedly attached to the spur gear at a common central axis. A locking pawl is provided. The locking pawl has a first end, a second end, is pivotally mounted to the gear case at the first end, has a disengaging lip at the second end and has an engaging notch located between the first end and the second end. The engaging notch is sized, shaped and located to fit the angled teeth of the ratchet wheel. A driving hand is provided. The driving hand has a proximal end and a distal end and has an engaging claw at the distal end. The claw is sized, shaped and located to engage the angled teeth of the ratchet wheel.

The driving hand is pivotally mounted to the actuating lever between the proximal and distal ends and has a spring mount at the proximal end. A spring is provided. The spring is mounted between the spring mount of the driving hand and the locking pawl and urges the engaging notch of the locking pawl to engage the angled teeth of the ratchet wheel as the engaging claw of the driving hand causes the ratchet wheel to rotate. A release cam is provided. The release cam is pivotally mounted to the gear case between the locking pawl and the driving hand. A ratchet release is provided. The ratchet release urges rotation of the release cam in a first, releasing direction. The release cam has first and second lobes. The first lobe engages the disengaging lip of the locking pawl and the second lobe bears against an inner lateral portion of the driving hand. The release cam causes the engaging notch and the engaging claw to disengage from the angled teeth of the ratchet wheel when rotated, thereby permitting the spur gear to rotate freely and the rack portion to be moved through the first and second aligned passthrough openings. The spring urges rotation of the release cam in a second, locking direction, thereby permitting motion of the ratchet wheel only in a direction urged by the engaging claw.

(4) In still another variant, the pin punch portion is formed of hardened material.

(5) In yet another variant, the pin punch portion has a pointed tip.

(6) In a further variant, a magnet is provided. The magnet is attached adjacent the second end of the retaining bar and has sufficient strength to secure a pin of a roller chain after removal from a chain.

(7) In a final variant, an illuminating fixture is provided. The fixture is attached to either the retaining bar or the gear case and has a beam directed to the barrier portion of the retaining bar.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-7 illustrate a conveyor chain pin remover 10 providing the desired features that may be constructed from the following components. As illustrated in FIG. 1, a gear case 14 is provided. The gear case 14 has an attached handle 18, an actuating lever 22, a ratchet mechanism 26 engaged by the actuating lever 18 and first 30 and second 34 aligned passthrough openings. A retaining bar 38 is provided. The retaining bar 38 has a first end 42 and a second end 46, is attached adjacent the first end 42 to the gear case 14 and has a chain retaining fixture 50 located adjacent the second end 46. The chain retaining fixture 50 has a barrier portion 54 located orthogonally to the retaining bar 38 and has a central aperture 58 located in the barrier portion 54. A ram 62 is provided. The ram 62 has a first end 66, a second end 70, a pin punch portion 74 located at the first end 66 and a rack portion 78 extending substantially from the second end 70 toward the pin punch portion 74.

The rack portion 78 is sized and shaped to fit slidably through first 30 and second 34 aligned passthrough openings with teeth 82 of the rack portion 78 engaging the ratchet mechanism 26. As illustrated in FIG. 2, the pin punch portion 74 is sized, shaped and located to fit slidably through the central aperture 58 and is smaller in diameter than pins 86 of a roller chain 90.

Figure 4:
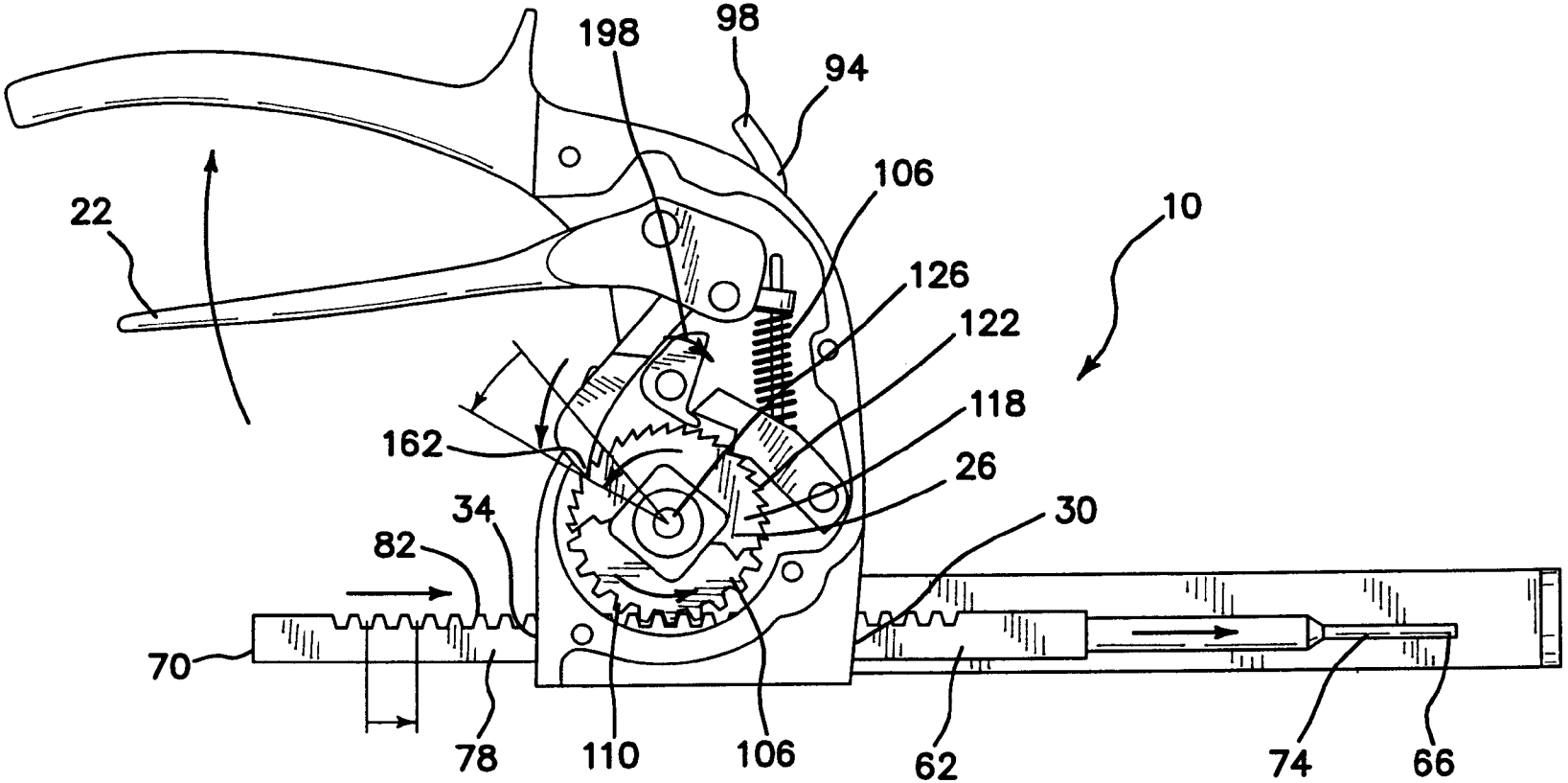
FIG. 4 is a cutaway front side elevational view of the FIG. 1 embodiment illustrating the relative motion of the internal parts when the ratchet release is disengaged and the actuating lever is operated.
Figure 5:
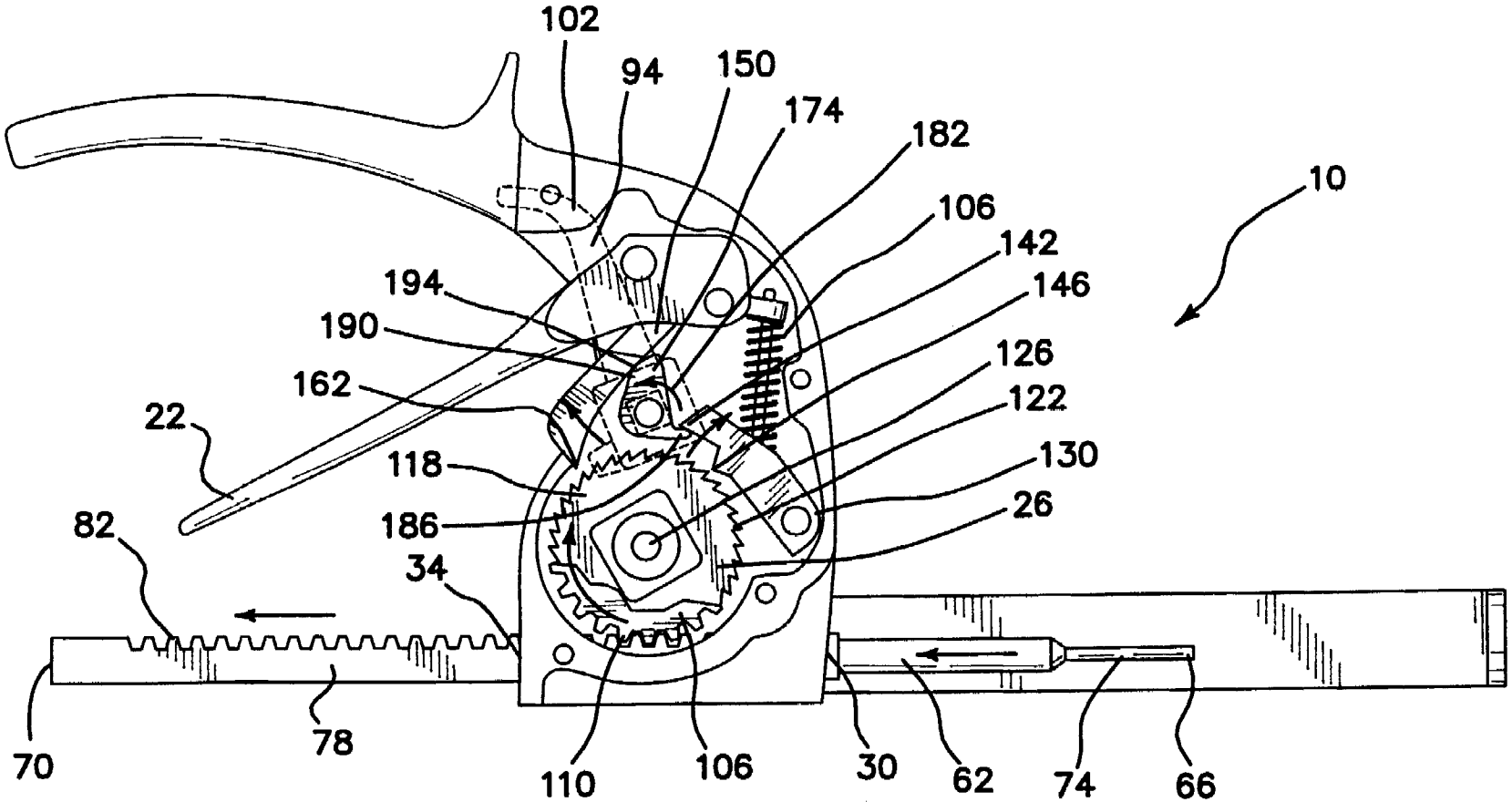
FIG. 5 is a cutaway front side elevational view of the FIG. 1 embodiment illustrating the relative motion of the internal parts when the ratchet release is engaged and the ram moved toward the gear case.
Figures 6, 8:
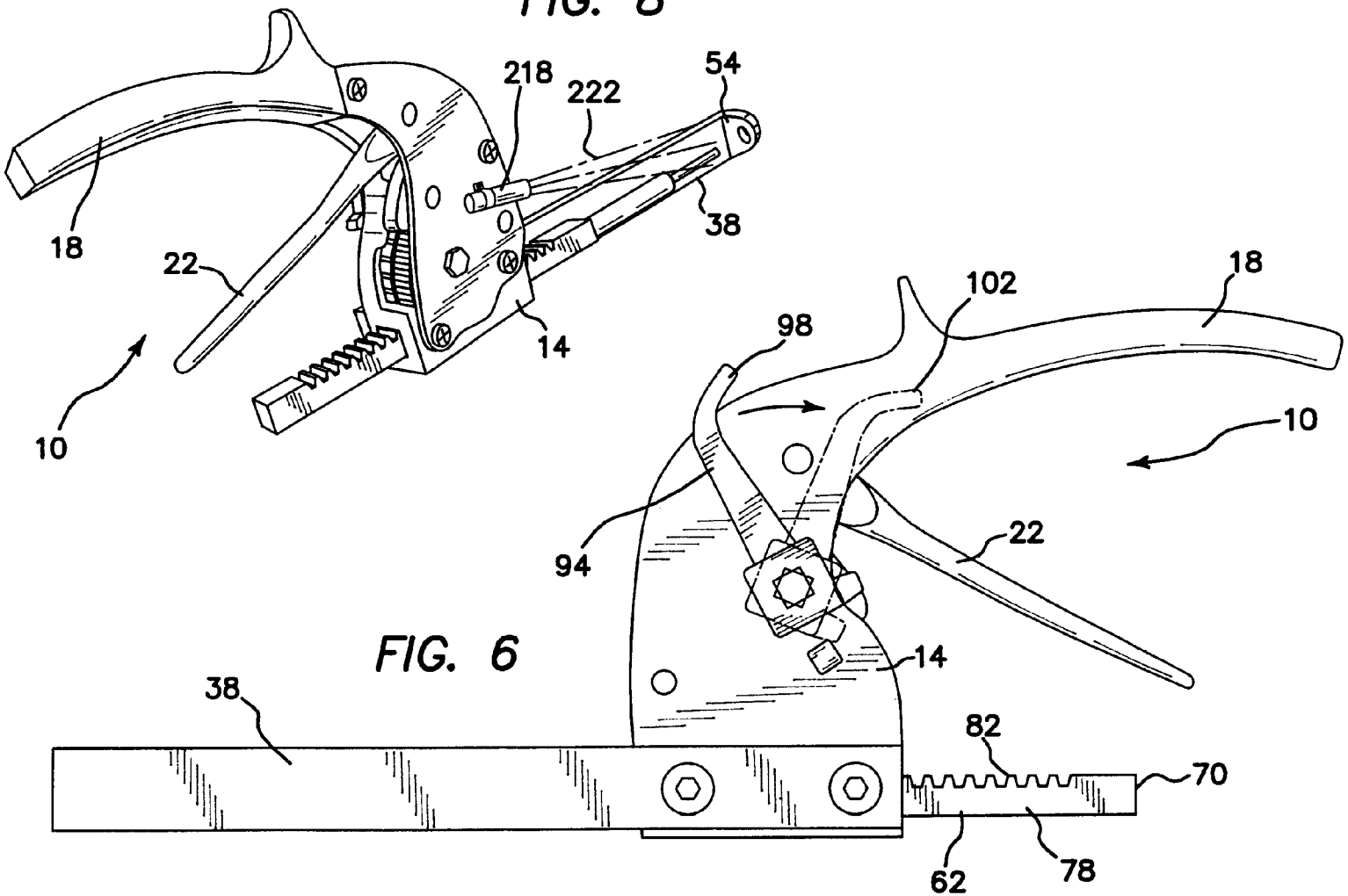
FIG. 6 is a rear side elevational view of the FIG. 1 embodiment illustrating movement of the ratchet release.
FIG. 8 is a perspective view of the FIG. 1 embodiment with the addition of an illuminating fixture to the gear case.

(2) In a variant of the invention, as illustrated in FIGS. 4-6, a ratchet release 94 is provided. The ratchet release 94 moves between a first position 98 and a second position 102, alternately engaging and disengaging the ratchet mechanism 26 and the actuating lever 22. A spring 106 is provided. The spring 106 urges the ratchet release 94 toward the first position 98. When the ratchet release 94 is in the second position 102, the rack portion 78 of the ram 62 slides freely through the first 30 and second 34 aligned passthrough openings.

(3) In another variant, as illustrated in FIGS. 4-6, the ratchet mechanism 26 further includes a spur gear 106. The spur gear 106 has teeth 110 sized and shaped to engage the teeth 82 of the rack portion 78. A ratchet wheel 118 is provided. The ratchet wheel 118 has angled teeth 122 and is fixedly attached to the spur gear 106 at a common central axis 126. A locking pawl 130 is provided. The locking pawl 130 has a first end 134, a second end 138, is pivotally mounted to the gear case 14 at the first end 134, has a disengaging lip 142 at the second end 138 and has an engaging notch 146 located between the first end 134 and the second end 138. The engaging notch 146 is sized, shaped and located to fit the angled teeth 122 of the ratchet wheel 118. A driving hand 150 is provided. The driving hand 150 has a proximal end 154 and a distal end 158 and has an engaging claw 162 at the distal end 158. The claw 162 is sized, shaped and located to engage the angled teeth 122 of the ratchet wheel 118.

The driving hand 150 is pivotally mounted to the actuating lever 22 between the proximal 154 and distal 158 ends and has a spring mount 166 at the proximal end 154. A spring 106 is provided. The spring 106 is mounted between the spring mount 166 of the driving hand 150 and the locking pawl 130 and urges the engaging notch 146 of the locking pawl 130 to engage the angled teeth 122 of the ratchet wheel 118 as the engaging claw 162 of the driving hand 150 causes the ratchet wheel 118 to rotate. A release cam 174 is provided. The release cam 174 is pivotally mounted to the gear case 14 between the locking pawl 130 and the driving hand 150. As illustrated in FIG. 5, a ratchet release 94 is provided. The ratchet release 94 urges rotation of the release cam 174 in a first, releasing direction 182. The release cam 174 has first 186 and second 190 lobes. The first lobe 186 engages the disengaging lip 142 of the locking pawl 130 and the second lobe 190 bears against an inner lateral portion 194 of the driving hand 150. The release cam 174 causes the engaging notch 146 and the engaging claw 162 to disengage from the angled teeth 122 of the ratchet wheel 118 when rotated, thereby permitting the spur gear 106 to rotate freely and the rack portion 78 to be moved through the first 30 and second 34 aligned passthrough openings. As illustrated in FIG. 4, the spring 106 urges rotation of the release cam 174 in a second, locking direction 198, thereby permitting motion of the ratchet wheel 118 only in a direction urged by the engaging claw 162.

(4) In still another variant, the pin punch portion 74 is formed of hardened material.

Figure 1:
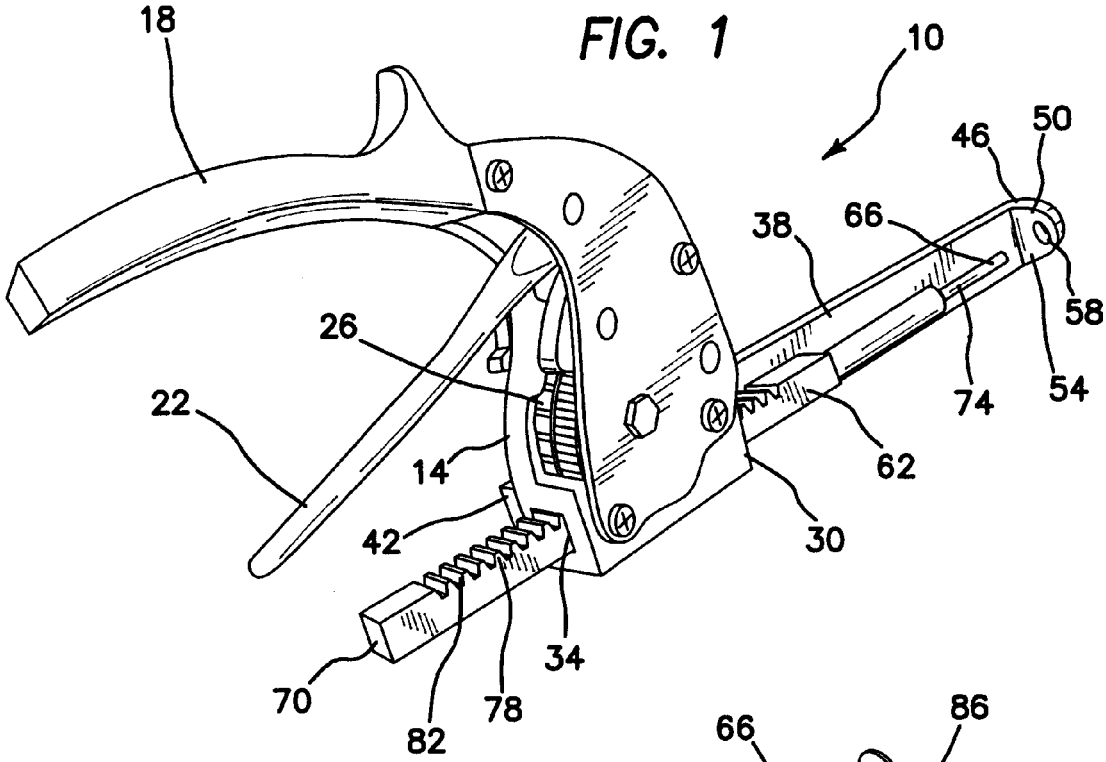
FIG. 1 is a perspective view of the preferred embodiment of the invention.
Figure 2:
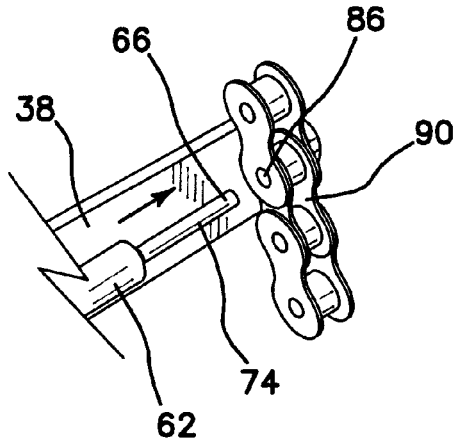
FIG. 2 is an enlarged perspective view of the second end of the retaining bar of the FIG. 1 embodiment with a section of conveyor chain in place.
Figure 7:
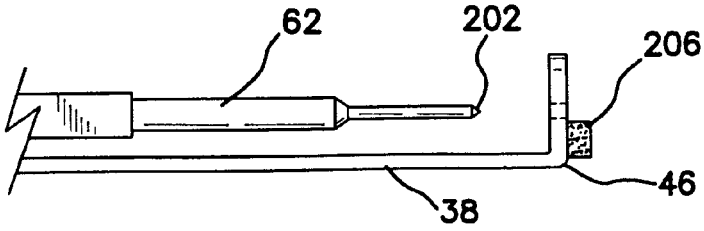
FIG. 7 is an enlarged side elevational view of the second end of the retaining bar and ram illustrating the conical tip of the ram.
Figure 3:
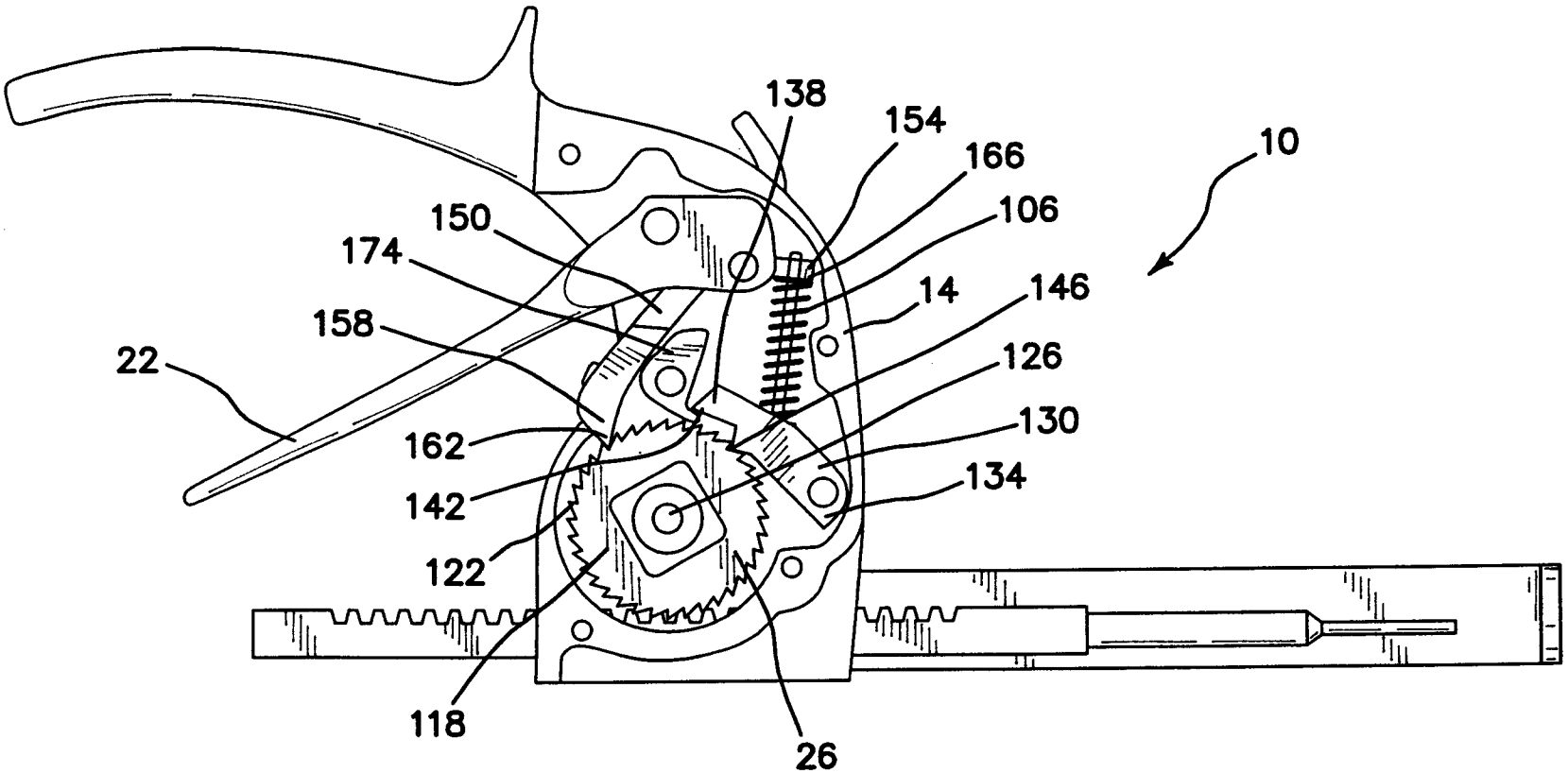
FIG. 3 is a cutaway front side elevational view of the FIG. 1 embodiment illustrating the internal features of the gear case.

(5) In yet another variant, as illustrated in FIG. 7, the pin punch portion 74 has a pointed tip 202.

(6) In a further variant, a magnet 206 is provided. The magnet 206 is attached adjacent the second end 46 of the retaining bar 38 and has sufficient strength to secure a pin 86 of a roller chain 90 after removal from a chain 90.

(7) In a final variant, an illuminating fixture 218 is provided. The fixture 218 is attached to either the retaining bar 38 or the gear case 14 and has a beam 222 directed to the barrier portion 54 of the retaining bar 38.

The conveyor chain pin remover 10 has been described with reference to particular embodiments. Other modifications and enhancements can be made without departing from the spirit and scope of the claims that follow.

The invention claimed is:

1. A conveyor chain pin remover, comprising:

a gear case, said gear case having an attached handle, an actuating lever, a ratchet mechanism engaged by said actuating lever and first and second aligned passthrough openings;

a retaining bar, said retaining bar having a first end and a second end, being attached adjacent said first end to said gear case and having a chain retaining fixture disposed adjacent said second end, said chain retaining fixture having a barrier portion disposed orthogonally to said retaining bar and having a central aperture disposed in said barrier portion;

a ram, said ram having a first end, a second end, a pin punch portion disposed at said first end and a rack portion extending substantially from said second end toward said pin punch portion;

said rack portion being sized and shaped to fit slidably through said first and second aligned passthrough openings and teeth of said rack portion engaging said ratchet mechanism; and said pin punch portion being sized, shaped and disposed to fit slidably through said central aperture and being smaller in diameter than pins of a roller chain.

2. The conveyor chain pin remover, as described in claim 1, further comprising:

a ratchet release, said ratchet release moving between a first position and a second position, alternately engaging and disengaging said ratchet mechanism and said actuating lever;

a spring, said spring urging said ratchet release toward said first position; and whereby, when said ratchet release is in said second position, said rack portion of said ram slides freely through said first and second aligned passthrough openings.

3. The conveyor chain pin remover, as described in claim 1, wherein said ratchet mechanism further comprises:

a spur gear, said spur gear having teeth sized and shaped to engage said teeth of said rack portion;

a ratchet wheel, said ratchet wheel having angled teeth and being fixedly attached to said spur gear at a common central axis;

a locking pawl, said locking pawl having a first end, a second end, being pivotally mounted to said gear case at said first end, having a disengaging lip at said second end and having an engaging notch disposed between said first end and said second end;

said engaging notch being sized, shaped and disposed to fit said angled teeth of said ratchet wheel;

a driving hand, said driving hand having a proximal end and a distal end, having an engaging claw at said distal end, said claw being sized, shaped and disposed to engage said angled teeth of said ratchet wheel;

said driving hand being pivotally mounted to said actuating lever between said proximal and distal ends and having a spring mount at said proximal end;

a spring, said spring being mounted between said spring mount of said driving hand and said locking pawl and urging said engaging notch of said locking pawl to engage said angled teeth of said ratchet wheel as said engaging claw of said driving hand causes said ratchet wheel to rotate;

a release cam; said release cam being pivotally mounted to said gear case between said locking pawl and said driving hand;

a ratchet release, said ratchet release urging rotation of said release cam in a first, releasing direction;

said release cam having first and second lobes, said first lobe engaging said disengaging lip of said locking pawl, said second lobe bearing against an inner lateral portion of said driving hand;

said release cam causing said engaging notch and said engaging claw to disengage from said angled teeth of said ratchet wheel when rotated, thereby permitting said spur gear to rotate freely and said rack portion to be moved through said first and second aligned passthrough openings; and said spring urging rotation of said release cam in a second, locking direction, thereby permitting motion of said ratchet wheel only in a direction urged by said engaging claw.

4. The conveyor chain pin remover, as described in claim 1, wherein said pin punch portion is formed of hardened material.

5. The conveyor chain pin remover, as described in claim 1, wherein said pin punch portion has a pointed tip.

6. The conveyor chain pin remover, as described in claim 1, further comprising a magnet, said magnet being attached adjacent said second end of said retaining bar and having sufficient strength to secure a pin of a roller chain after removal from a chain.

7. The conveyor chain pin remover, as described in claim 1, further comprising an illuminating fixture, said fixture attached to either of said retaining bar and said gear case and having a beam directed to said barrier portion of said retaining bar.

* * * * *